US008801062B2

(12) United States Patent
Mansfield et al.

(10) Patent No.: US 8,801,062 B2
(45) Date of Patent: Aug. 12, 2014

(54) CLAMPING DEVICE

(75) Inventors: Bradley Ernest Mansfield, Margaret River (AU); Peter Frederick Mansfield, West Perth (AU)

(73) Assignee: Clampsafe International Pty Ltd, West Perth (AU)

( * ) Notice: Subject to any disclaimer, the term of this patent is extended or adjusted under 35 U.S.C. 154(b) by 0 days.

(21) Appl. No.: 13/520,492

(22) PCT Filed: Dec. 16, 2010

(86) PCT No.: PCT/AU2010/001700

§ 371 (c)(1),
(2), (4) Date: Jan. 16, 2013

(87) PCT Pub. No.: WO2011/072341

PCT Pub. Date: Jun. 23, 2011

(65) Prior Publication Data

US 2013/0106125 A1 May 2, 2013

(30) Foreign Application Priority Data

Dec. 18, 2009 (AU) ..... 2009251026

(51) Int. Cl.
*B66C 1/34* (2006.01)
*B66C 1/14* (2006.01)
*B66C 1/12* (2006.01)

(52) U.S. Cl.
CPC .... *B66C 1/14* (2013.01); *B66C 1/12* (2013.01)
USPC ... 294/82.14; 294/82.11; 294/74; 24/132 WL

(58) Field of Classification Search
USPC ..... 294/82.14, 82.11, 74; 24/132 R, 24/132 WL, 135 R, 135 K
See application file for complete search history.

(56) References Cited

U.S. PATENT DOCUMENTS

| | | | | |
|---|---|---|---|---|
| 284,431 | A * | 9/1883 | Johnson | 188/65.3 |
| 829,542 | A * | 8/1906 | Newell | 24/132 R |
| 1,490,445 | A | 4/1924 | Wilson | |
| 3,310,852 | A | 3/1967 | Flanders | |

(Continued)

FOREIGN PATENT DOCUMENTS

| | | |
|---|---|---|
| EP | 1764337 | 7/2008 |
| GB | 2326668 | 12/1998 |
| GB | 2343913 | 10/2002 |

OTHER PUBLICATIONS

Supplementary European Search Report; EP 10 83 6852; May 15, 2013.

Gillett, Tim, Australian Patent Office, "International Search Report", International Application No. PCT/AU2010/001700, mailed on Jan. 31, 2011 (2 pages).

(Continued)

*Primary Examiner* — Gregory Adams
*Assistant Examiner* — Gabriela Puig
(74) *Attorney, Agent, or Firm* — Fish & Richardson P.C.

(57) ABSTRACT

A safety clamping device for clamping onto a first rope portion and retaining a second rope portion. The clamping device comprises a clamping portion and a retaining portion. The clamping portion clamps onto the first rope portion, and comprises first and second clamping members in use hingedly coupled to one another such that the clamping portion is movable between an open configuration suitable for receiving the first rope portion and a clamping configuration suitable for clamping onto the first rope portion. The retaining portion retains the second rope portion relative to the position of the first rope portion, and is coupled to the clamping portion.

20 Claims, 4 Drawing Sheets

(56) References Cited

U.S. PATENT DOCUMENTS

| | | | | |
|---|---|---|---|---|
| 4,417,758 | A * | 11/1983 | Vaders | 294/82.14 |
| 4,709,952 | A | 12/1987 | Selby | |
| 5,816,636 | A * | 10/1998 | Gibson et al. | 294/82.14 |
| 6,942,532 | B2 * | 9/2005 | Snyder | 441/75 |
| 2007/0063522 | A1 * | 3/2007 | Byrne | 294/74 |

OTHER PUBLICATIONS

Weber, R., Australian Patent Office, "International Preliminary Report on Patentability (Chapter II of the Patent Cooperation Treaty)", International Application No. PCT/AU2010/00170, mailed on Oct. 11, 2011 (4 pages).

* cited by examiner

CLAMPING DEVICE

FIELD OF THE INVENTION

The present invention relates to a clamping device. In particular, although not exclusively, the present invention relates to a sling safety clamping device.

BACKGROUND OF THE INVENTION

A load, such as a bundle of casing pipes, may be transported by means of a wire rope arranged in a sling configuration. However, using such a sling configuration may present difficulties. For example, as the load is lifted, the sling configuration becomes relatively taut under the applied tension. However, when the bundle is set down at a desired destination, the sling is no longer under as much tension and may no longer be held in the relatively taut sling configuration. Accordingly, the pipes may be free to spill outwardly from the bundle, thereby presenting a hazard to workers.

Previous methods and devices have been used for retaining the sling in a relatively taut configuration after the load has been delivered. However, such methods and devices have been relatively time consuming and have required at least two people to implement. For example, one such method involves using a bulldog clamp and marlin twine in an attempt to retain the sling in a relatively taut sling configuration. Not only is a method such as this time consuming, but removal of the marlin twine will usually be done by cutting the marlin twine from the junction which will cause the sling configuration to lose its relative tautness suddenly. This can still lead to spillage of the load, thereby endangering the worker tasked with cutting the marlin twine.

Throughout this specification, it will be appreciated that a "rope" or a "sling" may be formed from any suitable material including, but not limited to, Hessian, nylon or metallic materials.

SUMMARY OF THE INVENTION

In accordance with a first aspect of the present invention, there is provided a safety clamping device for clamping onto a first rope portion and retaining a second rope portion, the clamping device comprising:

a clamping portion for clamping onto the first rope portion, the clamping portion comprising first and second clamping members in use hingedly coupled to one another such that the clamping portion is movable between an open configuration suitable for receiving the first rope portion and a clamping configuration suitable for clamping onto the first rope portion; and a retaining portion for retaining the second rope portion relative to the position of the first rope portion, the retaining portion being coupled to the clamping portion.

The retaining portion may be arranged such that, in use, the second rope portion is positioned transverse to the first rope portion at a predetermined position along the first rope portion.

The clamping portion may comprise a fastening member arranged to retain the clamping portion in the clamping configuration.

In one embodiment, the fastening member comprises a bolt. A first end of the bolt may be mounted on the first clamping member and a portion of the bolt may be receivable by the second clamping member when the clamping portion is moved to the clamping configuration. The fastening member may further comprise a nut for tightening and loosening the clamping portion in the clamping configuration.

Embodiments of a clamping device wherein the fastening member comprises a bolt and a tightening nut provide the advantage of allowing the clamping member to be gradually loosened from and tightened with the first rope portion so that, when the clamping device is used to retain the rope portions in a sling configuration suitable for lifting a bundle of pipes or the like, the clamping device may be gradually engaged with the first rope portion when the sling configuration is relatively taut, and similarly gradually disengaged when the load has been set down so that the sling configuration does not lose tension immediately.

Embodiments of the clamping device with the fastening member may allow the clamping device to be clamped onto the first rope portion to retain the second rope portion, and correspondingly unclamped from the first rope portion by one operator.

In one embodiment, the fastening member is swivelably coupled to the first clamping member. In embodiments wherein the fastening member comprises a bolt and a nut, a first end of the bolt may be swivelably coupled to the first clamping member. The bolt may be arranged to prevent the nut from being removed from the cylindrical body by unscrewing, for example by a flanged region at a second end.

The first and second clamping members may be hingedly coupled to one another in any appropriate manner. The first and second clamping members may be hingedly coupled such that the clamping portion is one piece. Alternatively, the first and second clamping members may be hingedly coupled such that the clamping members are disengagable from one another at the hinge coupling.

The first and second clamping members may be clasped and coupled to one another in any appropriate manner. The first and second clamping members may be clasped and coupled such that the clamping portion is one piece. Alternatively, the first and second clamping members may be clasped and coupled such that the clamping members are disengagable from one another at the clasp coupling.

Engaging surfaces of the clamping portion for engaging with the first rope portion may be arranged so as to substantially reduce damage to the first rope portion when the clamping portion is engaged with and/or disengaged from the first rope portion, for example by having a substantially smooth surface.

Such engaging surfaces of the clamping portion provide the advantage of reducing the amount of wear to the first rope portion if other means were otherwise used. This is particularly useful when the clamping device is used on relatively expensive wire slings.

The retaining portion may be shaped so as to prevent the second rope portion from moving in such a way so as to reduce the tension on the sling configuration, for example by preventing the second rope portion from jumping over the first rope portion. In use, the second rope portion may be retained between the retaining portion and the first rope portion.

In one embodiment, the retaining portion is shaped such that the second rope portion is retained in a region defined by the shape of the retaining portion. In one embodiment, the retaining-portion has a curved or hooked shape. The second rope portion may be retained in a region between the first rope portion and the retaining portion. The retaining portion may be hook-like in shape. In one embodiment, the retaining portion comprises at least two hook-like fingers wherein the second rope portion may be retained in an intersection region defined between the at least two hook-like fingers and the first rope portion, and wherein the first rope portion may be at least partially receivable in a region defined between the at least two hook-like fingers.

The retaining portion may be integrally formed with the first clamping member. This may allow at least a portion of the clamping device to be formed with large scale production methods such as casting or injection molding. It will be appreciated, however, that the retaining portion may be formed with the first clamping member in any appropriate way, for example by welding.

The fastening means, such as the bolt and nut, may be coupled with the first clamping member by inserting a pin through an aperture in the first end of the bolt and welding the pin into respective pin receiving apertures of the first clamping member.

The second clamping member may be arranged such that at least a portion of the fastening member is retainable within a cut-out of the second clamping member when the clamp is engaged in the clamping configuration. In embodiments wherein the fastening member comprises a bolt and a nut and wherein the bolt is coupled at a first end to the first clamping member by a swivel, the bolt may be swung about its swivel and received by the cut-out of the second clamping member.

In one embodiment, the cut-out of the second clamping member is beveled so as to retain at least a portion of the nut when the clamp is engaged in the clamping configuration.

Providing a beveled cut-out may substantially reduce the ease with which the bolt may be accidentally disengaged from the second clamping member when the clamping portion is in the engaging configuration after the bolt has been swung into position so as to be received by the second clamping member.

In accordance with a second aspect of the present invention, there is provided a method of forming the safety clamping device of the first aspect, wherein the retaining portion is integrally formed with the clamping portion.

The method of forming the safety clamping device may comprise forming the retaining portion and the clamping portion from casting or injection molding.

BRIEF DESCRIPTION OF THE DRAWINGS

Embodiments of the present invention will now be described, by way of example only, with reference to the accompanying drawings.

DETAILED DESCRIPTION OF THE SPECIFIC EMBODIMENTS

Embodiments of the present invention relate to a clamping device for clamping onto a first rope portion of a rope sling and retaining a second rope portion of the rope sling relative to the position of the first rope portion. This allows the clamping device to be used with a rope sling arranged in a sling configuration used to lift a bundle of pipes or casings, wherein the relative positions of the first and second rope portions of the rope sling are retained such that a relatively taut sling configuration is maintained when the bundle is delivered to a desired destination e.g. shore to rig or rig to shore. Such lifting methods are also commonly used on building or mining sites.

Figure 1:
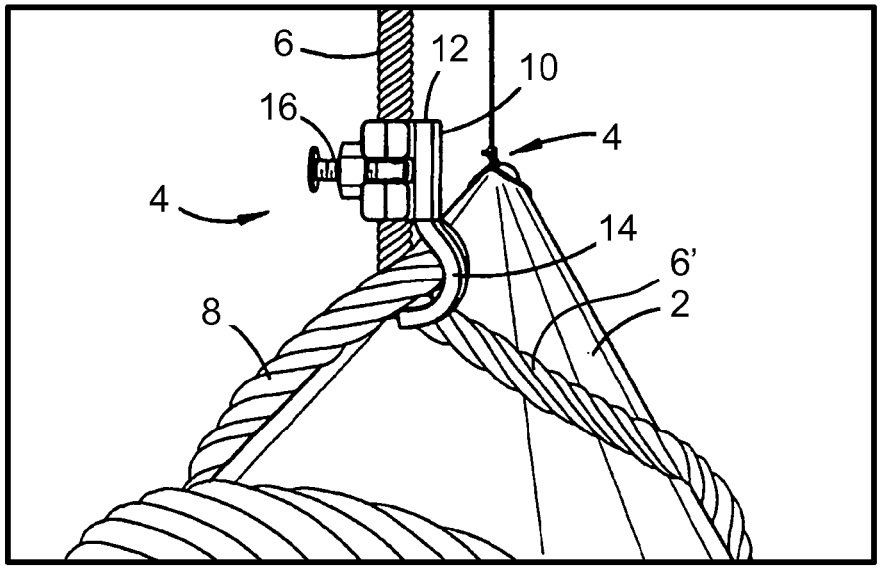
FIG. 1 is a side perspective view of a bundle of pipes being lifted by a rope sling, and showing portions of the rope sling being retained in a position relative one another by a clamping device in accordance with an embodiment of the present invention.
Figure 2:
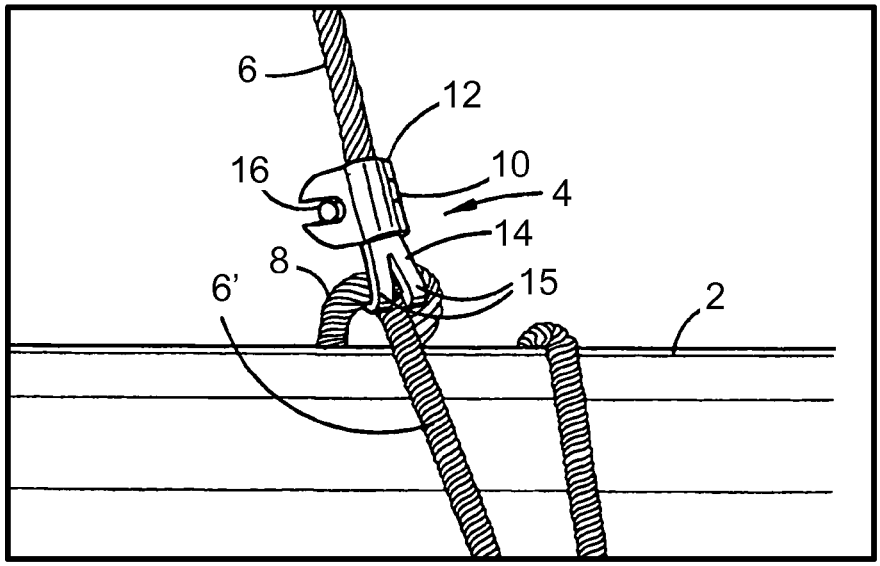
FIG. 2 is a front perspective view of the pipe bundle, rope sling and clamping device shown in FIG. 1.

Such a clamping device is shown clamped to a first rope portion and retaining a second rope portion of a rope sling in FIG. 1. In particular, FIG. 1 shows a bundle of pipes 2 being lifted by a plurality of rope slings 4, the rope slings each comprising a first rope portion 6, a second rope portion 8, the second rope portion 8 being looped around the first rope portion 6 and wherein the relative positions of the first and second rope portions 6, 8 are retained in position by a clamping device 10.

The clamping device 10 comprises a clamping portion 12 for clamping onto the first rope portion 6 and a retaining portion 14 for retaining the second rope portion 8 in a position relative to the first rope portion 6. The second rope portion 8 is retained in a region formed between the retaining portion 14 and the first rope portion 6. In this embodiment, the retaining portion has a curved shape. This arrangement is further accommodated by hook-like fingers 15 of the retaining portion 14 which are spaced apart so as to create a region for at least partially receiving a lower end 6' of the first rope portion 6.

It will be appreciated that, although the retaining portion 14 has been described as comprising curved-like fingers 15 that form a curved shape for retaining the second rope portion 8, any alternative configurations and/or shapes that will appropriately achieve the function of retaining the second rope portion 8 relative to the first rope portion 6 may be used with embodiments of the present invention.

Figure 3:
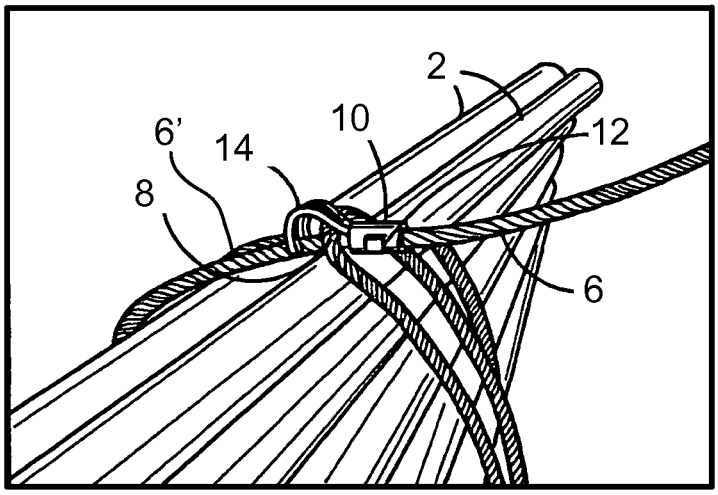
FIG. 3 is a side perspective view of the pipe bundle, rope sling and clamping device of FIG. 1 showing the pipe bundle having been delivered to a destination.

Although the clamping device 10 is shown retaining the first and second rope portions 6, 8 in positions relative to one another when the rope sling 4 is being used for lifting the pipe bundle 2, the clamping device 10 also provides the advantage of retaining the relative positions of the first and second rope portions 6, 8 when the pipe bundle 2 has been set down at a destination and slack has been introduced to the rope sling 4 since the rope sling 4 is no longer under full tension from fully supporting the pipe bundle 2. This arrangement is shown in FIG. 3.

If the clamping device 10 was not clamped to the first rope portion 6 and the retaining portion 14 was not arranged so as to retain the second rope portion 8 relative to the first rope portion 6, the second rope portion 8 would have a tendency to move upwards along the first rope portion 6 thereby allowing the rope bundle 2 to spill outwards in a possibly uncontrolled fashion. As shown in FIG. 3 however, the clamping device 10 prevents the second rope portion 8 from moving upwards along the first rope portion 6, thereby preventing the outward movement of pipes that form the pipe bundle 2.

When it is desired that the clamping device 10 be removed from the rope sling so as to allow the first and second rope portions 6, 8 to move relative one another such that the pipes of pipe bundle 2 can be released from the rope sling 4, the clamping device 10 can be gradually disengaged from the first rope portion 6 by loosening the fastening member 16 of the clamping portion 12.

Figure 4:
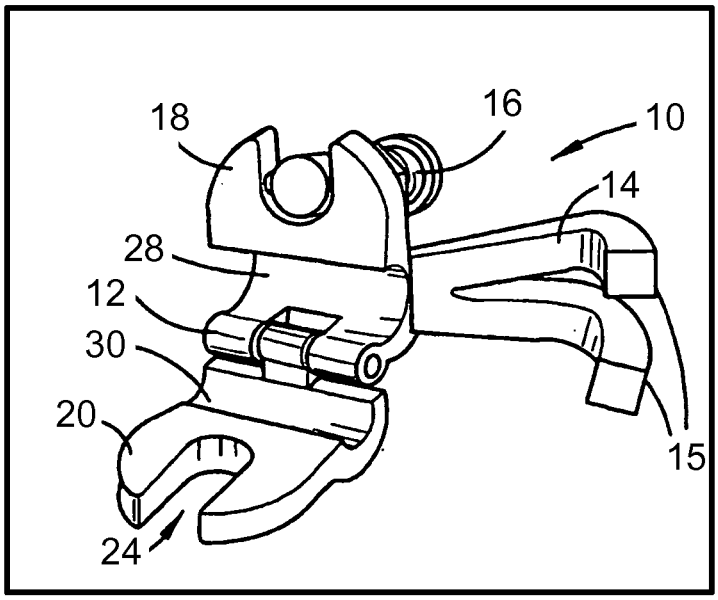
FIG. 4 is a perspective view of the clamping device of FIG. 1 shown in an open configuration.
Figure 5:
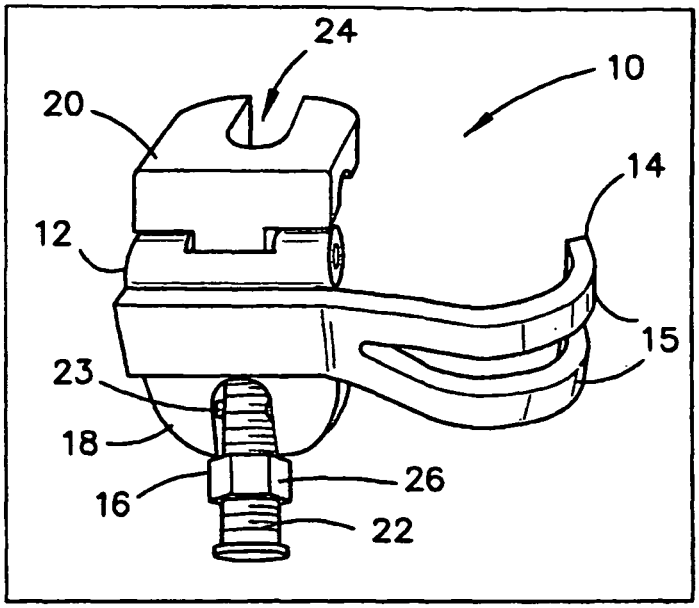
FIG. 5 is a reverse angle perspective view of the clamping device shown in FIG. 4.
Figure 6:
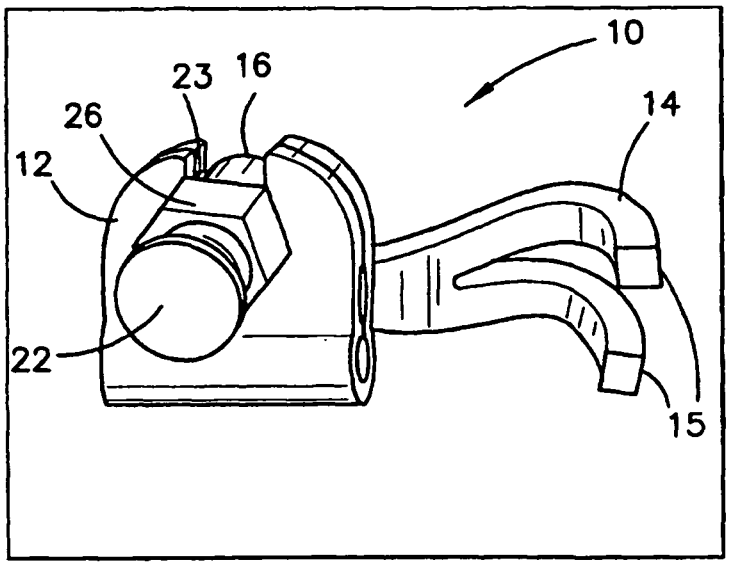
FIG. 6 is a perspective view of the clamping device of FIG. 1 shown in a clamping configuration.
Figure 7:
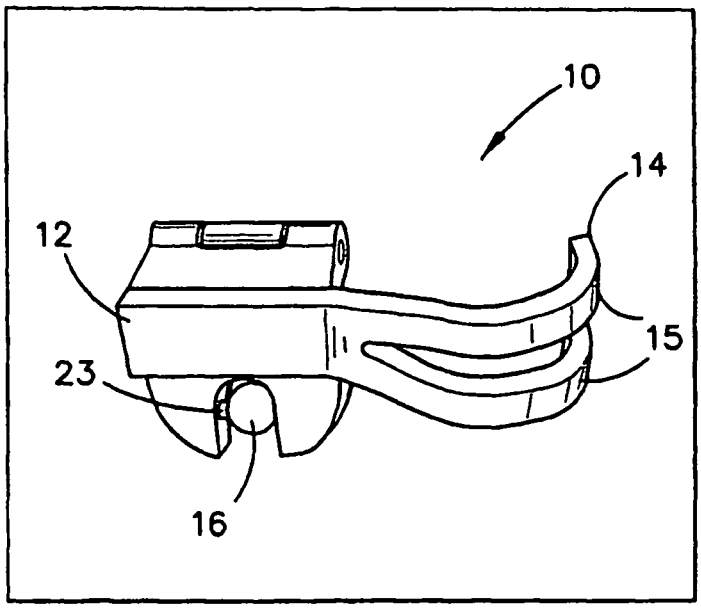
FIG. 7 is a reverse angle perspective view of the clamping device shown in FIG. 6.

When the clamping device 10 is disengaged from the first rope portion 6 by loosening fastening member 16, the clamping device 10 may be moved from a clamping configuration, (shown also in FIGS. 6 and 7), to an open configuration shown in FIGS. 4 and 5. This is achieved as the clamping portion 12 comprises first and second clamping members 18, 20 which are hingedly connected to one another so as to be moveable between the open and clamping configurations. The first and second clamping members 18, 20 may be hingedly coupled to one another in any appropriate manner. The first and second clamping members 18, 20 may be hingedly coupled such that the clamping portion 12 is one piece. Alternatively, the first and second clamping members 18, 20 may be hingedly coupled such that the clamping members 18, 20 are disengagable from one another at the hinge coupling.

In this embodiment the fastening member 16 comprises a bolt 22 swivel mounted at a first end to the first clamping member 18 by means of a pin 23 (see FIG. 5) and receivable by a cut-out 24 of the second clamping member 20. When the first and second clamping members 18, 20 are moved to the clamping configuration, the bolt 22 may be swiveled so as to be received by the cut-out 24 of the second clamping member and a nut 26 may be screwed so as to retain the first and second clamping members 18, 20 in the clamping configuration. It will be appreciated that the cut-out 24 may be beveled such that the nut 26 is received at least partially within the cut-out 24 such that a lateral force applied to the bolt 22, such as by accidental knocking, will not easily cause the bolt 22 to be forced out of cut-out 24 thereby accidentally opening the clamping device 10 to the open configuration. It will further be appreciated that, although the fasting member 16 has been described in terms of a bolt 22 and a nut 26, any appropriate fasting means may be used.

Allowing the nut 26 to be screwed so as to secure the clamping device 10 in the clamping configuration and to be unscrewed so as to allow the clamping device 10 to be moved to the open configuration provides the significant advantage of allowing the clamping device 10 to be moved gradually between each of these positions, such as when unclamping the clamping device 10 from the first rope portion 6.

The second end of the bolt 22 may be flanged so as to retain the nut 26 on the bolt 22.

A further advantage is provided by providing relatively smooth internal rope engaging surfaces 28, 30 on the first and second clamping members 18, 20 respectively. This may substantially reduce the amount of wear caused to the first rope portion 6 which is particularly advantageous when used with relatively expensive ropes such as wire ropes as they may not need to be replaced as often.

The retaining portion 14 may be integrally formed with the first clamping member 18. This may allow at least a portion of the clamping device 10 to be formed with large scale production methods such as casting or injection molding. In embodiments wherein the first clamping member 18 comprises the swivel coupled bolt 22, the clamping and retaining portions may be integrally formed, and the bolt 22 may be coupled with the first clamping member 18 by inserting a pin 23 through an aperture in the first end of the bolt 22 and welding the pin 23 into respective pin receiving apertures of the first clamping member 18. Forming the clamping device 10 in this manner may assist in reducing the number of joins that may be prone to failure; however, it will be appreciated that the clamping device 10 may be formed in any appropriate way, such as by welding the retaining portion 14 to the first clamping member 18.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

It will be understood to persons skilled in the art of the invention that many modifications may be made without departing from the spirit and scope of the invention.

The invention claimed is:

1. A safety clamping device for clamping onto a first rope portion and retaining a second rope portion, the clamping device comprising:

a clamping portion for clamping onto the first rope portion; and a retaining portion for retaining the second rope portion relative to the position of the first rope portion, the retaining portion being coupled to the clamping portion;

wherein the clamping portion comprises:

first and second clamping members in use hingedly coupled to one another such that the clamping portion is movable between an open configuration suitable for receiving the first rope portion and a clamping configuration suitable for clamping onto the first rope portion; and a fastening member arranged to retain the clamping portion in the clamping configuration, the fastening member being swivelably coupled to the clamping portion.

2. The safety clamping device of claim 1, wherein the retaining portion is arranged such that, in use, the second rope portion is positioned transverse to the first rope portion at a predetermined position along the first rope portion.

3. The safety clamping device of claim 1, wherein the fastening member comprises a bolt.

4. The safety clamping device of claim 3, wherein a first end of the bolt is mounted on the first clamping member and a portion of the bolt is receivable by the second clamping member when the clamping portion is moved to the clamping configuration.

5. The safety clamping device of claim 4, wherein the fastening member further comprise a nut for tightening and loosening the clamping portion in the clamping configuration.

6. The safety clamping device of claim 5, wherein the bolt is arranged to prevent the nut from being removed from the bolt by unscrewing.

7. The safety clamping device of claim 6, wherein the bolt is flanged at a second end.

8. The safety clamping device of claim 1, wherein engaging surfaces of the clamping portion for engaging with the first rope portion have a substantially smooth surface.

9. The safety clamping device of claim 1, wherein the retaining portion is shaped so as to prevent the second rope portion from moving upwards relative to the first rope portion.

10. The safety clamping device claim 1, wherein, in use, the second rope portion is retained between the retaining portion and the first rope portion.

11. The safety clamping device claim 1, wherein the retaining portion is shaped such that the second rope portion is retained in a region defined by the shape of the retaining portion.

12. The safety clamping device claim 1, wherein the retaining portion has a curved shape.

13. The safety clamping device of claim 12, wherein the retaining portion is hook-like in shape.

14. The safety clamping device of claim 13, wherein the retaining portion comprises at least two hook-like fingers wherein the second rope portion is retained in a region defined between the at least two hook-like fingers and the first rope portion, and wherein the first rope portion may be at least partially receivable in a region defined between the at least two hook-like fingers.

15. The safety clamping device of claim 14, wherein the fastening member is coupled to the first clamping member and the second clamping member is arranged such that at least a portion of the fastening member is retainable within a cut-out of the second clamping member when the clamp is engaged in the clamping configuration.

16. The safety clamping device of claim 15, wherein the cut-out of the second clamping member is beveled so as to retain at least a portion of the nut when the clamp is engaged in the clamping configuration.

17. A method of forming the safety clamping device claim 1, wherein the retaining portion is integrally formed with the clamping portion.

18. The method of claim 17, wherein forming the safety clamping device comprises forming the retaining portion and the clamping portion from casting or injection molding.

19. The safety clamping device of claim 1, wherein the clamping members are arranged such that end portions of the clamping members are in contact in the proximity of the fastening member.

20. The safety clamping device of claim 1, wherein engaging surfaces of the clamping portion for engaging with the first rope portion are arranged so as to reduce damage to the first rope portion when the clamping portion is engaged with the first rope portion.

* * * * *

UNITED STATES PATENT AND TRADEMARK OFFICE

CERTIFICATE OF CORRECTION

PATENT NO. : 8,801,062 B2
APPLICATION NO. : 13/520492
DATED : August 12, 2014
INVENTOR(S) : Bradley Ernest Mansfield and Peter Frederick Mansfield It is certified that error appears in the above-identified patent and that said Letters Patent is hereby corrected as shown below:

In the Claims,

Col. 6, line 54, claim 10, delete "device claim" and insert -- device of claim --, therefor.

Col. 6, line 57, claim 11, delete "device claim" and insert -- device of claim --, therefor.

Col. 6, line 61, claim 12, delete "device claim" and insert -- device of claim --, therefor.

Col. 7, line 15, claim 17, delete "device claim" and insert -- device of claim --, therefor.

Signed and Sealed this
Eleventh Day of November, 2014

Michelle K. Lee

Michelle K. Lee
*Deputy Director of the United States Patent and Trademark Office*